United States Patent [19]

McGraw

[11] Patent Number: 4,674,416

[45] Date of Patent: Jun. 23, 1987

[54] OPTICAL DISK STORAGE SAFE

[76] Inventor: Thomas F. McGraw, 9034 Ashmeade Dr., Fairfax, Va. 22032

[21] Appl. No.: 647,783

[22] Filed: Sep. 6, 1984

[51] Int. Cl.[4] ..... E05G 1/04; E05B 15/16

[52] U.S. Cl. ..... 109/23; 109/59 R; 109/66; 70/333 R

[58] Field of Search ..... 109/24.1, 50-52, 109/66, 45, 68, 23, 55, 59 R, 59 T, 87; 70/329, 333 R, 333 A, 444; 292/DIG. 25

[56] References Cited

U.S. PATENT DOCUMENTS

| | | | |
|---|---|---|---|
| 124,540 | 3/1872 | Bussey | 70/444 |
| 1,425,400 | 8/1922 | Lowe | 109/66 |
| 1,635,736 | 7/1927 | Banta | 109/23 |
| 1,724,424 | 8/1929 | Sandboldt, Jr. | 292/DIG. 25 |
| 1,852,053 | 4/1932 | Jendrek | 109/66 |
| 2,947,160 | 8/1960 | Wolters | 70/333 R |
| 3,945,329 | 3/1976 | Bywater | 109/68 |
| 4,195,579 | 4/1980 | Doyel | 109/52 |

FOREIGN PATENT DOCUMENTS

| | | | |
|---|---|---|---|
| 2337398 | 2/1974 | Fed. Rep. of Germany | 109/45 |

*Primary Examiner*—Gary L. Smith
*Assistant Examiner*—Neill Wilson
*Attorney, Agent, or Firm*—Jacob N. Erlich; Donald J. Singer

[57] ABSTRACT

A storage safe for containing securely therein a plurality of flexible media such as optical video disks. The storage safe is made of a sturdy body which is capable of being embedded in a cement floor, or the like. A cover encloses the cavity-like interior of the body and can only be removed by activating a combination mechanism assembly by applying the proper combination thereto. Any tampering with the combination mechanism assembly is defeated by the novel construction of the combination mechanism assembly. The cover has a slot therethrough and a labyrinth-like structure associated therewith so as to allow the flexible media to pass into the interior of the body but which prevents its unauthorized withdrawal therefrom. In addition, this labyrinth-like structure directs any undesireable fluid away from the flexible media stored within the body of the safe.

11 Claims, 12 Drawing Figures

OPTICAL DISK STORAGE SAFE

STATEMENT OF GOVERNMENT INTEREST

The invention described herein may be manufactured and used by or for the Government for governmental purposes without the payment of any royalty thereon.

BACKGROUND OF THE INVENTION

This invention relates generally to storage devices, and, more particularly, to a storage safe capable of reliably securing therein a flexible media such as an optical disk containing digitized data thereon.

One of the highest-density storage media in use today for digitized data is what is commonly referred to as the optical disk. Generally, optical disks are transparent or reflective disks, usually of plastic or coated in plastic, which have been encoded with a form of digitized information by imposition of "pits" in the surface. The configuration of these pits may be decoded for reassembly of the original information, often displayed on a television monitor. Over the last several years, a standard disk configuration has emerged, with the information-bearing pits essentially engraved in a metal film sandwiched between two protective disks. These disks are physically rigid, in the fashion of a phonograph record, and are reproduced by a hydraulic "pressing" procedure. The hydraulic process for reproduction of conventional video disks has substantially contributed to a very high investment requirement to tool up for production of these disks. A new process has been designed for relief of the heavy investment problem, and promises to find many applications where customer ownership of the means of production is important, such as those where the data content of the disks would be classified. The disk of such a system is simply a piece of photographic film, reproduced by a simple contact printing process. The pits are replaced by a photographically-produced dark images. Another important characteristic of this optical disk is that the media is flexible.

While tremendous advantages accompany such flexible optical disks, and the aforementioned design in particular, the tremendous concentration of classified information leaves with it problems of secure storage of such disks. In general, each disk is capable of storing thousands of video frames of imagery, graphics, text or any other form of information ultimately displayable, for example, on a video screen. Such stored information corresponds to a large number of printed pages. In fact, a one-inch stack of disks could conservatively contain the equilvalent of over 100,000 printed pages of text. This shrinking volume of data will definitely have an impact on the way data is stored in the future. Two, four, and five-drawer safes of the past will become impractical for storage of optical disks, because of the relatively large volume of space such safes occupy. In addition, smaller safes simply set on an office floor represent the risk of theft to another location for "punching" and opening.

It is clearly evident, therefore, from the above information that with the continued increased use of such optical disks, it is now essential that a practical and reliable means for storage of such disks should be made available. Further, as pointed out above, the safes or storage facilities now available for other types of media are not practical for the storage of the flexible optical disks described above.

SUMMARY OF THE INVENTION

The present invention overcomes the problems encountered in the past and as set forth in detail hereinabove by providing a storage safe capable of reliably storing flexible optical disks or other types of flexible media.

The storage safe of the present invention is mainly intended as a floor safe, that is, a safe which has been permanently embedded in a concrete floor, or for mobile use, when welded into or becoming an integral part of the frame of a truck or armored vehicle. Although the safe is primarily intended for use in the protection of information on flexible optical disks, it can also be used for the storage of other flexible media, such as paper or photographic materials.

The storage safe of the present invention allows for the ability to deposit such optical disks therein without access to the combination of the safe. This is accomplished with a uniquely designed slot arrangement within the safe. When used, the disk is placed within a thin plastic envelope, perforated or grooved to defeat any attempt to withdraw the disk surreptitiously by means of a vacuum source. Therefore, for the actual withdrawal of the optical disk from the safe, the correct combination must be entered so as to open the safe in order to withdraw the material.

The storage safe of this invention allows for this easy entry of the media to be stored by incorporating therein a labyrinth-like angular entry path which permits insertion of a flexible disk or other flexible material, and exludes any rigid material or tool from entering. Furthermore, at the bottom of this labyrinth-like path is a drip guide which conducts any liquid introduced into the safe away from the stacked disks, safely and to the side of the safe where it may drip to a condensation space for later removal. A disk stacker is included within the interior of the safe. This stacker is in the form of an inclined flat sheet for support of the disk in a semi-vertical position. A divider is utilized to separate the storage area from the combination area.

In order to withdraw the optical disks from the storage safe, the correct combination must be known and applied to the combination mechanism which is conventional in its makeup and not part of the present invention. Protection of the combination mechanism, however, is an integral part of the present invention. Protection of the combination mechanism incorporates a recessed combination dial which is mounted on a rigid shaft for penetration through the safe lid. In addition, a flexible shaft is attached to the rigid shaft so that if the dial is removed with the thought of simple smashing or manipulating the combination mechanism by force, the flexible shaft will thwart that attempt. In other words, if the rigid part of the dial shaft is simply punched into the safe, the flexible shaft will bend over, preventing the shaft from reentering the guide hole. If a tool is inserted to rotate the flexible shaft thus bent, no advantage is gained since the combination must still be known for its operation. Furthermore, the two ends of the flexible shaft are offset, so that any tool successfully introduced down the entry hole will miss the combination mechanism, thereby effectively isolating it.

It is therefore an object of this invention to provide a highly reliable storage safe which is capable of providing maximum security to the storage of modern, high-density data storage materials such as optical disks.

It is a further object of this invention to provide a storage safe for securely storing a wide variety of flexible media.

It is another object of this invention to provide a storage safe which provides maximum security by its anchorage into a concrete floor or a heavy vehicle frame.

It is still another object of this invention to provide a storage safe which is capable of easily accepting flexible media therein and yet provides removal from the storage area of any fluids which may have entered through the media entrance.

It is still a further object of this invention to provide a storage safe which incorporates therein a uniquely designed combination mechanism assembly which includes an offset, flexible combination shaft.

It is an even further an object of this invention to provide a storage safe in which entry into the safe for depositing material can be accomplished without a combination while the removal of such material necessitates knowledge of the combination.

It is still a further of this invention to provide a storage safe which is economical to produce and which utilizes conventional, currently available components that lend themselves to standard mass producing manufacturing techniques.

For a better understanding of the present invention, together with other and further objects thereof, reference is made to the following description, taken in conjunction with the accompanying drawings and its scope will be pointed out in the appended claims.

BRIEF DESCRIPTION OF THE DRAWINGS

FIG. 4 is a pictorial representation of the lid portion of the storage safe of the present invention shown in its removed condition and illustrating the combination mechanism assembly;

DETAILED DESCRIPTION OF THE PREFERRED EMBODIMENT

Figure 1:
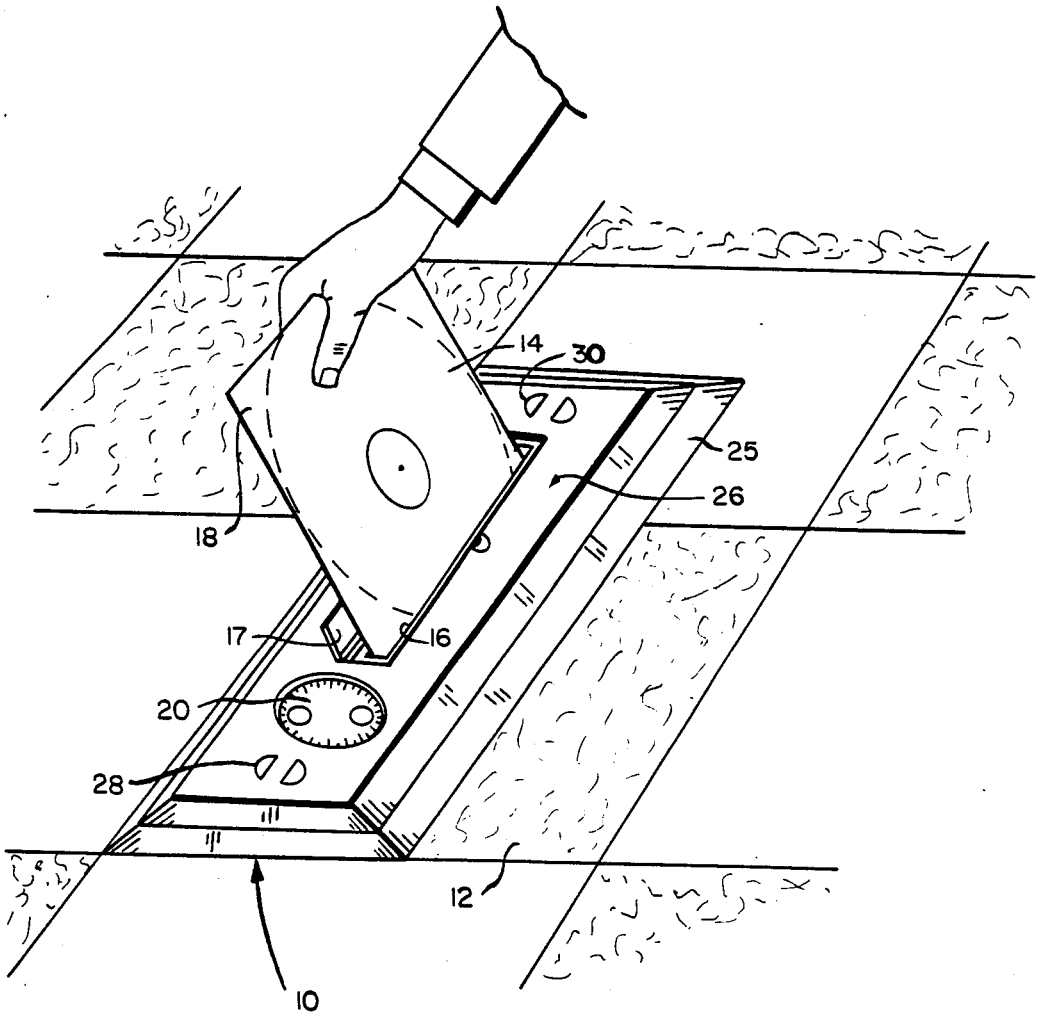
FIG. 1 is a pictorial representation of the storage safe of the present invention embedded within a concrete base and illustrating the insertion therein of a flexible optical disk.
Figures 2, 3:
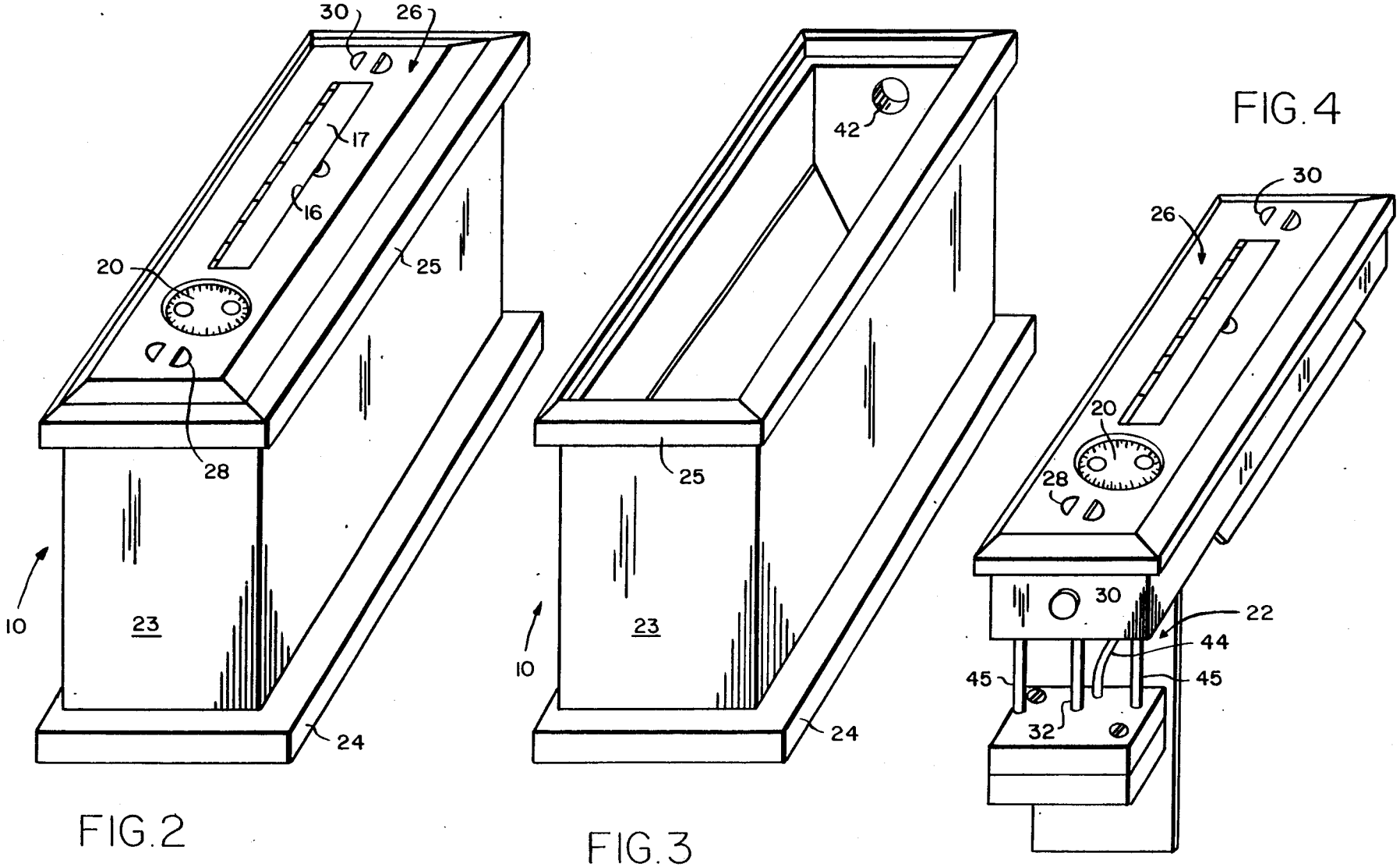
FIG. 2 is a pictorial representation of the exterior of the storage safe of the present invention.
FIG. 3 is a pictorial illustration of the body of the storage safe of the present invention having the lid portion thereof removed.

Reference is now made to FIGS. 1 and 2 of the drawing which pictorially illustrate the optical disk storage safe 10 of the present invention embedded within a concrete floor 12 (FIG. 1) and in a position removed from concrete floor 12 (FIG. 2). Reference to FIGS. 1 and 2 enables one to visualize and better appreciate the overall external configuration of the storage safe 10 of the present invention. Storage safe 10 is primarily intended for protection of information of flexible optical information media such as an optical disk 14 but can be utilized for other types of flexible media such as paper materials or photographs.

FIG. 1 also clearly illustrates the insertion of optical disk 14 into storage safe 10 without the need of the combination. This is accomplished by inserting optical disk 14 directly into the deposit slot 16. As shown in FIG. 1 of the drawings, optical disk 14 is encased in a thin plastic envelope 18, preferably perforated or grooved (not shown) to defeat any attempt to withdraw optical disk 14 surreptitiously by means of a vacuum source through slot 16. Consequently, the only manner in which this material can be removed from storage safe 10 is by applying the correct combination into the recessed dial 20 of the combination mechanism assembly 22 of the storage safe 10 of the present invention and more clearly shown in FIGS. 4–6 of the drawings.

Reference is once again made to FIG. 2 of the drawings which shows more clearly the entire external configuration of storage safe 10 prior to its insertion within concrete floor 12 or its welding into a vehicle frame (not shown). There are two separate flanges formed on the exterior of the body 23 of the storage safe 10, a bottom flange or anchor flange 24 and an upper flange 25 which surrounds the heavy lid 26 of the storage safe 10. The body 23 of storage safe 10 is preferably made of a heavy cast metal or heavy metal weldment. Utilization of the anchor flange 24 prevents body 23 of safe 10 from being pulled from its concrete bed in floor 12. For further security, body 23 may be welded to the reinforcing rods in the concrete thereby providing even more resistance to its removal.

Located within the heavy lid 26 is the deposit door or slot 16 having biased cover 17 connected thereto. In addition, the recessed dial 20 of the combination mechanism assembly 22 also resides in the heavy lid 26. A pair of finger grips or lifts 28 and 30 are cut out of heavy lid 26 on opposite sides thereof to aid in the removal of lid 26 upon entering the appropriate combination into recessed dial 20 of combination mechanism assembly 22.

Figure 5:
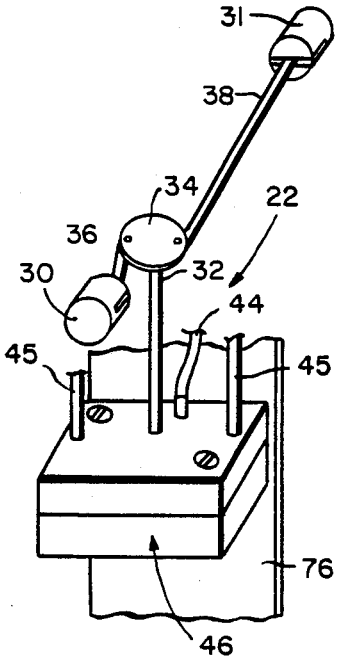
FIG. 5 is a pictorial representation of the combination mechanism assembly utilized with the storage safe of the present invention.

Reference is now made to FIGS. 3 and 4 of the drawings which illustrates body 23 having lid 26 removed therefrom thereby exposing the interior of storage safe 10. As shown in FIG. 4 of the drawings, the dial 20 of combination mechanism assembly 22 is physically incorporated with lid 26. In this particular embodiment, as illustrated in FIGS. 4 and 5, a two-tumbler version of the combination mechanism assembly 22 is incorporated within the present invention.

In such an embodiment, a pair of tumblers 30 and 31 (see FIG. 5 in particular) are connected to a rotatable upstanding rod 32 and plate or disk 34 by means of a pair of elongated bars 36 and 38, respectively. By utilizing the appropriate combination with recessed dial 20, tumblers 30 and 31 can be moved into and out of engagement with tumbler receptacles 40 and 42, respectively, as shown more clearly in FIGS. 3 and 6 of the drawings. The combination mechanism, itself, forming part of combination mechanism assembly 22, is conventional and contained within housing 46. A flexible shaft 44 interconnects the combination mechanism contained in housing 46 to recessed dial 20 in the manner to be described in greater detail hereinbelow. Housing 46 is securely affixed to the undersurface of lid 26 by support rods 45. However, it is the use of flexible shaft 44 to interconnect recessed dial 20 to the conventional combination mechanism located in housing 46 which substantially increases the reliability and tamperproofness of safe 10.

Figure 7:
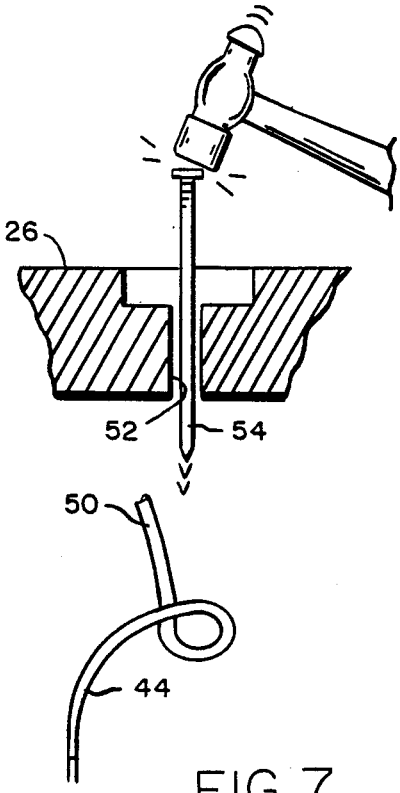
FIG. 7 is a pictorial view, shown partly in cross-section, of the rigid shaft of the combination mechanism assembly of the storage safe of the present invention being "punched out"
Figure 8:
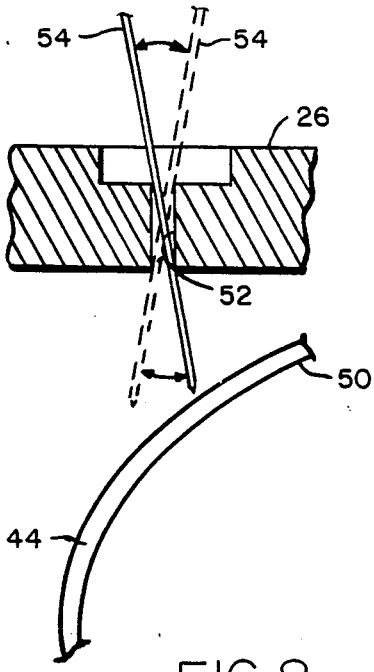
FIG. 8 is a pictorial view, shown partly in cross-section, of a tool attempting to manipulate the flexible shaft of the combination mechanism assembly of the storage safe of the present invention.

As stated hereinabove, the protection of the combination mechanism within housing 46 is an integral part of the present invention. First of all, combination dial 20, which is recessed within lid 26, is affixed to a rigid shaft 50 clearly shown in FIG. 6 of the drawings. Rigid shaft 50 allows for the possible penetration of lid 26 of storage stage 10 of the present invention. By providing an elongated opening 52 for rigid shaft 50 within lid 26, design of this opening 52 forces any tool, such as nail 54 illustrated in FIG. 7, employed to "punch" the safe to be directed along a specific path, that is, one which is away from the combination mechanism within housing 46. Consequently, the end of the rigid shaft 50, which has flexible shaft 44 attached thereto, will bend or spring away from opening 52. By the utilization of flexible shaft 44, if the recessed dial 20 is removed with the thought of simply smashing or manipulating the combination by force as illustrated in FIGS. 7 and 8, the flexible shaft 44 will bend over, preventing the shaft from reentering the guide hole 52. Contact with the combination mechanism in housing 46 is therefore lost.

Secondly, for added security the attachment of flexible shaft 44 to the combination mechanism within housing 46 may be designed to separate on impact. However, even if tool 54 were inserted to rotate flexible shaft 44 thus bent, no advantages would be gained since the combination must still be overcome.

Figure 6:
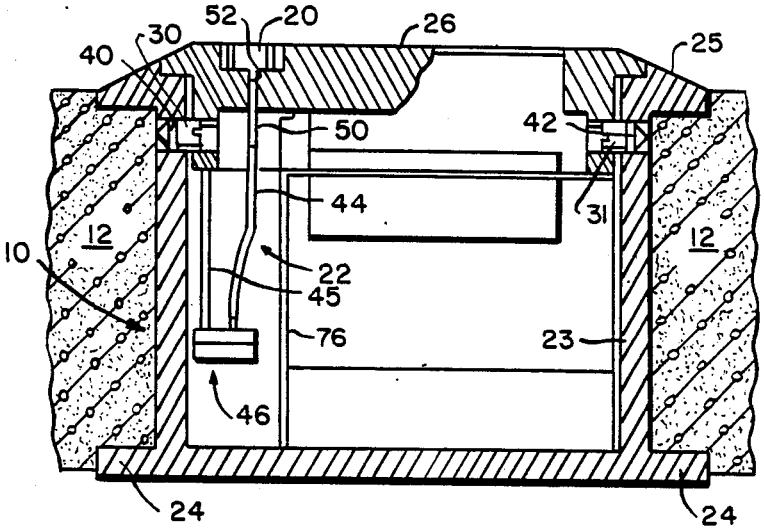
FIG. 6 is a side view of the storage safe of the present invention shown partly in cross-section.

As is visible from FIG. 6 of the drawings, the two ends of flexible shaft 44 are offset, so that any tool successfully introduced into the entry hole 52 will miss the combination mechanism in housing 46, thereby effectively isolating it from forceable entry. Once flexible shaft 44 is detached from recessed dial 20, tumblers 30 and 31 stay in their locked position as shown in FIG. 6 and lid 26 cannot be removed from body 23 of storage safe 10. Furthermore, if the combination mechanism within housing 46 is simply pounded until destroyed, the couplers will also remain unmoved.

The combination mechanism assembly 22 thus combines two effective characteristics to foil unauthorized entry; first, the thick lid 26 of the safe and the small diameter of the shaft or entry hole 52 severely limit the angular maneuverability of any probe or tool 54 introduced therein; and second, the actual combination mechanism within housing 46 is misaligned from the rigid dial shaft 50 far enough to exceed the limits imposed by the shaft or entry hole 52. Under those circumstances, a probe or tool 54 introduced through the shaft hole 52 is unlikely to reach the combination mechanism within housing 46.

Figure 9:
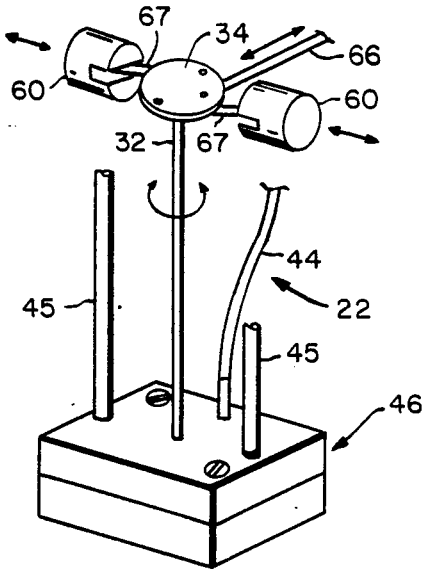
FIG. 9 is a partial pictorial representation of an alternate embodiment of the combination mechanism assembly utilized with the storage safe of the present invention.
Figure 10:
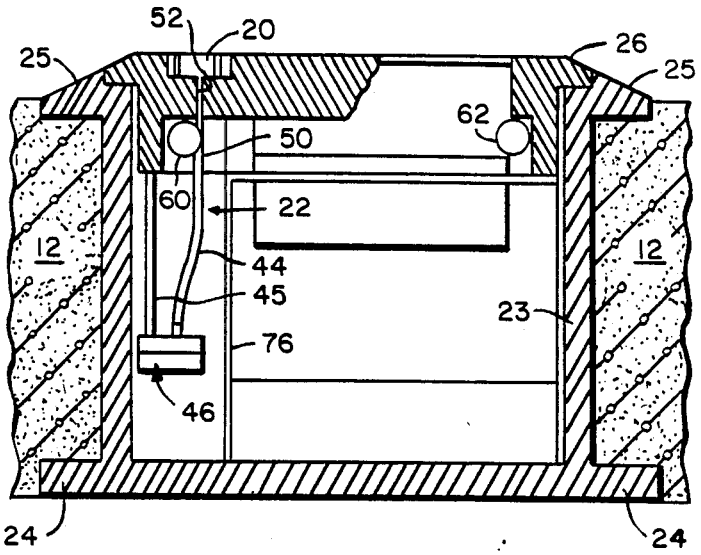
FIG. 10 is a side elevational view of the alternate embodiment of the combination mechanism assembly in the storage safe of the present invention, and shown partly in cross-section.
Figure 11:
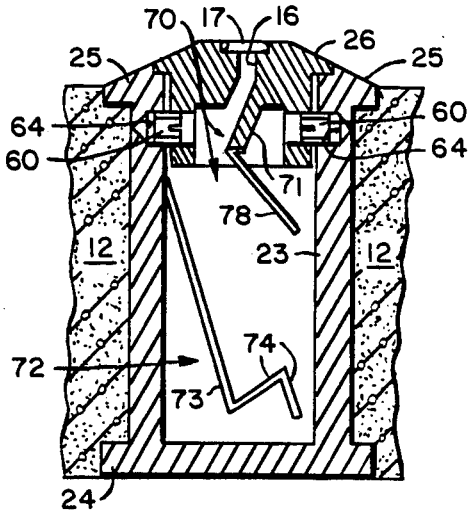
FIG. 11 is an end view of the alternate embodiment of the combination mechanism assembly in the storage safe of the present invention, and shown partly in cross-section.
Figure 12:
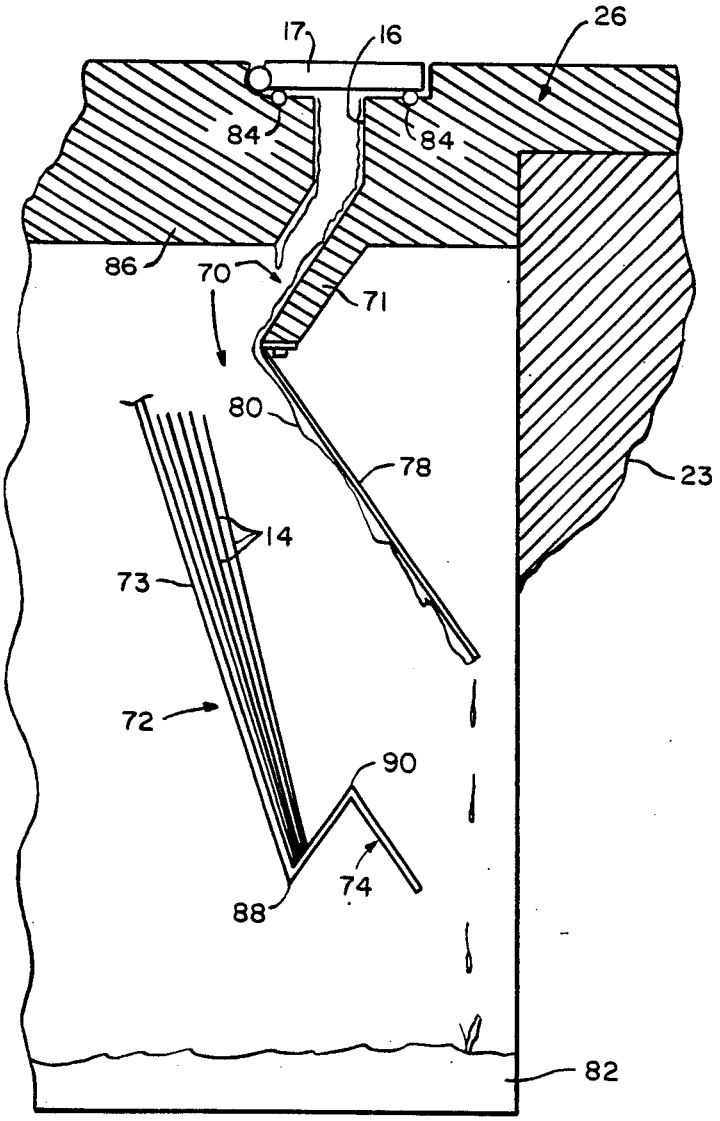
FIG. 12 is a cross-sectional view of a portion of the interior of the storage safe of the present invention illustrating the labyrinth-like configuration of the entry way.

Another version or embodiment of combination mechanisn assembly utilized with the storage safe 10 of the present invention is illustrated in FIGS. 9–11 of the drawings and will hereinafter be referenced by numeral 22' and referred to as four-tumbler combination mechanism assembly 22'. In such an embodiment of the present invention, a pair of tumblers 60 and a pair of tumblers 62 are positioned at opposite ends of lid 26, respectively. Each pair of tumblers 60 and 62 engage respective tumbler receptacles or recesses 64 located in the side walls of body 23 of the storage safe 10 of the present invention. As clearly seen in FIGS. 9–11, all similar elements of storage safe 10 will be given identical numerals so as to avoid confusion when referring to the various Figures of the drawings.

More specifically, upon operation of the embodiment described in FIGS. 9–11, upon entering of the combination into the combination mechanism within housing 46 by means of recessed dial 20, each of the pairs of tumblers 60 and 62 are withdrawn from the recesses 64 at both sides of body 23 of the storage safe 10. As shown in FIG. 9 of the drawings, a linkage 66 is utilized to engage and disengage tumblers 60 and 62 from within the appropriate recesses 64. This is accomplished by rotating plate or disk 34 which has pivotally mounted bars 67 attaching tumblers 60 and 62 thereto, respectively, for movement therewith. The remaining elements of combination mechanism assembly 22' are substantially identical to assembly 22 and therefore identical reference numerals will be utilized to designate the same structure in both assemblies.

Reference is once again made to FIG. 1 of the drawings, together with FIGS. 6, 10, 11 and 12 in order to illustrate the deposit or insertion feature of the storage safe 10 of the present invention. As can be seen from the above-mentioned Figures, a labyrinth-like arrangement 70 including an angled outstanding element 71 (see FIG. 12 in particular) is situated within the interior of body 23 of storage safe 10 juxtaposed deposit slot or opening 16. Element 71 provides an angular entry path (exaggerated for clarity) which permits the insertion of flexible optical disk 14 or other material through deposit opening 16 but excludes any rigid material or tool from insertion therein.

In addition, labyrinth-like arrangement 70 includes disk stacker 72 which is made of a substantially vertically inclined flat sheet of material 73 attached to one end thereof to the interior surface of body 23 adjacent the bottom of slot 16. Sheet 73 is bent in an inverted V-shaped configuration at 74, and is capable of supporting the optical disks 14 in a semi-vertical position. The flexibility of the optical disk dictates the need for such a stacker 72. A divider 76 as shown in FIGS. 6 and 10 of the drawings is utilized to separate the storage area from the combination area. Therefore, it is clearly illustrated that optical disks 14 may be easily inserted within the opening 16, for subsequent storage thereof, by the labyrinth-like configuration of the stacker 72 which allows for the accumulation of disks 14 but prevents the removal thereof.

In addition to the labyrinth-like configured arrangement 70 within the interior of the storage safe 10 is a drip guide 78 which conducts any liquid 80 introduced into the interior of body 23 of storage safe 10 away from the stacked disks 14 and safely to the side of the interior of the safe where it drips to a condensation space 82 for subsequent removal. The drip guide 78 is one element of a four-element system for minimizing the possibility that liquids, introduced accidentally or intentionally, can damage the contents of the storage safe 10. The other three contributing elements are: (1) the deposit door or cover 17, (2) the labyrinth-like element 71, and (3) stacker 72. All four elements together comprise the safe's defense against water and other medium-to-low-viscosity fluids.

Stated more succinctly, the four elements work together in the following manner. Door 17 provides the first line of defense. It is lightly spring-loaded to remain closed in the steady-state. Door 17 thus resists dust and small liquid spills. A small O-ring 84 (shown in FIG. 12) may be embedded in the mating surface of safe lid 26 for best performance. Liquids which penetrate past door 17 will be dealt with as follows: the liquid 80 runs down the surfaces of the entry path (the entry path width being exaggerated for clarity in FIG. 12 of the drawings), dripping off the short side 86 and continuing down the outstanding element 71 on the other side. The outstanding element 71 is long enough and angled properly so that the drips off the short side 86 are recaptured on the lowest surface of element 71. Adhesion of the liquid or fluid and the steep angles of the labyrinth-like arrangement 70 and drip guide 78 insure that the fluid transfers to the drip guide 78 and continues down to the side of the interior or body 23. The drip guide 78 is long enough to nearly contact the side of body 23.

The stacker 72, which is made of sheet metal, is oriented nearly vertically, and includes two functional bends at 88 and 90. The lower bend 88 is to ensure that discs 14 or film dropped through slot 16 tend to fall to the left and repose against the flat sheet 73 of stacker 72. A number of discs 14 may be accumulated in this manner. The upper bend 90 is placed inboard of the edge of the drip guide, so as to aid in directing liquid 80 harmlessly to the bottom 82 of the body 23 of safe 10. The lower (stacking) bend 88 of stacker 72 is fixed an inch or more above the bottom of body 23 to provide some margin of protection from the storage of accumulated contaminants (such as liquid 80). Accumulated contaminants or liquid 80 can be removed from the interior of body 23 when the lid 26 is removed during the removal of the optical disks 14.

In order to withdraw optical disks 14 from storage safe 10 of the invention, the correct combination must be known and applied by means of recessed dial 20 through shafts 50 and 44 to the combination mechanism in housing 46. Thereafter, lid 26 can be withdrawn from body 23 by lifting lid 26 by means of finger lifts 28 and 30 and the accumulated disks 14 easily removed. It is quite apparent that the storage safe of the present invention allows reliable insertion of optical disks 14 therein; safe storage thereof; and removable only if the proper combination is known.

Although this invention has been described with reference to particular embodiments, it will be understood that this invention is also capable of further and other embodiments within the spirit and scope of the appended claims.

I claim:

1. A storage safe for reliably securing therein flexible media, said storage safe comprising:

a body having a cavity formed within the interior thereof and having one end thereof open;

a cover operably connected to said open end of said body, said cover having means interconnected thereto for preventing the unauthorized removal of said cover from said body; and means connected to said cover for permitting the insertion therethrough of said flexible media and preventing the unauthorized withdrawal of said flexible media therefrom, said flexible media insertion permitting means including a labyrinth-like structure disposed within said cavity of said body, and said labyrinth-like structure including means for stacking said flexible media within said cavity of said body and means for preselectively directing fluid entering said insertion permitting means away from said flexible media stacking means.

2. A storage safe as defined in claim 1 wherein said fluid directing means comprises an outstanding element extending at a first preselected angle from the undersurface of said cover adjacent said flexible media insertion permitting means, and an element extending at a second preselected angle from said outstanding element in order to direct said fluid away from said stacking means.

3. A storage safe as defined in claim 2 wherein said stacking means comprises a substantially vertically inclined flat sheet of material located within said cavity of said body and attached at one end thereof adjacent said flexible media insertion permitting means.

4. A storage safe as defined in claim 3 wherein said flat sheet of material has a substantially inverted V-shaped bend at the other end thereof in order to prevent fluid from reaching said flexible media stacked on said stacking means.

5. A storage safe for reliably securing therein flexible media, said storage safe comprising:

a body having a cavity formed within the interior thereof and having one end open;

a cover operably connected to said open end of said body, said cover having means interconnected thereto for preventing the unauthorized removal of said cover from said body, said cover removal preventing means including a combination mechanism connected to said cover and situated within said cavity of said body and further having an operating shaft, a combination dial located within the exterior surface of said cover, said dial being positioned in lateral offset relationship with respect to said combination mechanism, a rigid shaft parallel to said operating shaft and connected to said dial, said rigid shaft passing through an opening in said cover adjacent said dial and being offset from said combination mechanism, and a flexible shaft interconnected at one end thereof to said rigid shaft and at the other end thereof to said combination mechanism; and means connected to said cover for permitting the insertion therethrough of said flexible media and preventing the unauthorized withdrawal of said flexible media therefrom, said flexible media insertion permitting means including a labyrinth-like structure disposed within said cavity of said body, and said labyrinth-like structure including means for stacking said flexible media within said cavity of said body.

6. A storage safe as defined in claim 5 wherein said labyrinth-like structure further includes means for preselectively directing fluid entering said insertion permitting means away from said flexible media stacking means.

7. A storage safe as defined in claim 6 wherein said fluid directing means comprises an outstanding element extending at a first preselected angle fromm the undersurface of said cover adjacent said flexible media insertion permiting means, and an element extending at a second preselected angle from said outstanding element in order to direct said fluid away from said stacking means.

8. A storage safe as defined in claim 7 wherein said stacking means comprises a substantially vertically inclined flat sheet of material located within said cavity of said body and attached at one end thereof adjacent said flexible media insertion permitting means.

9. A storage safe as defined in claim 8 wherein said flat sheet of material has a substantially inverted V-shaped bend at the other end thereof in order to prevent fluid from reaching said flexible media stacked on said stacking means.

10. A storage safe as defined in claim 9 wherein said cavity of said body contains therein a partition separating said combination mechanism from said labyrinth-like structure.

11. A storage safe as defined in claim 10 wherein said cover contains therein a pair of finger grips.

* * * * *